US006339689B1

(12) United States Patent
Sugiura

(10) Patent No.: US 6,339,689 B1
(45) Date of Patent: Jan. 15, 2002

(54) TONER COLLECTION DEVICE WITH DISPLACEABLE PARTITION

(75) Inventor: Yuzuru Sugiura, Kato-gun (JP)

(73) Assignee: Fujitsu Peripherals Limited, Hyogo (JP)

( * ) Notice: Subject to any disclaimer, the term of this patent is extended or adjusted under 35 U.S.C. 154(b) by 0 days.

(21) Appl. No.: 09/444,505

(22) Filed: Nov. 22, 1999

(30) Foreign Application Priority Data

Feb. 9, 1999 (JP) ..... 11-031579

(51) Int. Cl.[7] ..... G03G 21/10; G03G 21/12
(52) U.S. Cl. ..... 399/120; 399/358; 399/360
(58) Field of Search ..... 399/120, 360, 399/358, 359, 262

(56) References Cited

U.S. PATENT DOCUMENTS

| | | | | |
|---|---|---|---|---|
| 4,660,960 A | * | 4/1987 | Fukunaga et al. | 399/360 X |
| 4,963,940 A | * | 10/1990 | Nemoto et al. | 399/360 X |
| 5,084,734 A | * | 1/1992 | Yoshino et al. | 399/360 X |
| 5,126,799 A | | 6/1992 | Matsura et al. | |
| 5,781,841 A | | 7/1998 | Kouroku et al. | 399/360 |

FOREIGN PATENT DOCUMENTS

| | | |
|---|---|---|
| JP | 62-32483 | 2/1987 |
| JP | 2-153385 | 6/1990 |
| JP | 3-257478 | 11/1991 |
| JP | 4-127167 | 4/1992 |
| JP | 7-181785 | 7/1995 |
| JP | 8-006343 | 1/1996 |
| JP | 8-211717 | 8/1996 |
| JP | 9-034328 | 2/1997 |
| JP | 9-166912 | 6/1997 |
| JP | 9-274423 | 10/1997 |
| JP | 9-281866 | 10/1997 |
| JP | 10-161501 | 6/1998 |

* cited by examiner

*Primary Examiner*—William J. Royer
(74) *Attorney, Agent, or Firm*—Armstrong, Westerman, Hattori, McLeland & Naughton, LLP

(57) ABSTRACT

An exemplified object of the present invention is to provide a toner collection device that may effectively, easily and inexpensively utilize a storage space for waste toner. The toner collection device is provided with a displaceable partition in the storage space, and the partition may contact an agitator that may displace the partition.

22 Claims, 18 Drawing Sheets

TONER COLLECTION DEVICE WITH DISPLACEABLE PARTITION

BACKGROUND OF THE INVENTION

The present invention generally relates to image forming devices such as printers, and more particularly to a collection device capable of collecting used and waste toner. The present invention is suitable for a toner cartridge and a print unit for use with a color printer.

Toner (or a mixture of toner and carrier) developed on a photosensitive drum is mostly transferred on a printing paper by a transfer part in a printer, but a little remains on the photosensitive drum. This remaining toner is collected by a cleaner part and put in a collection container for disposal purposes. Many recent printers have integrated these functions into one unit, and this integration has disadvantageously made a complex and bulky structure. Especially, a waste toner collection device needs to allow a large capacity margin for an excessively large amount of waste toner that would be unusually used.

Toner comprises high-viscosity particulates. Waste toner disadvantageously accumulates in a heap when poured into the container through its upper opening and chokes the opening despite enough empty space remaining in it, preventing a full use of the container's capacity. For size reduction and effective use of the capacity for waste toner, it has been suggested to provide an agitator and a toner mechanism that levels off the waste toner. Prior art structures, however, have been complex and expensive.

SUMMARY OF THE INVENTION

Accordingly, it is a general object of the present invention to provide a novel and useful toner cartridge, print unit and printer in which the above disadvantages are eliminated.

More specifically, another exemplified object of the present invention is to provide a toner collection device that may utilize container's space for waste toner effectively, easily and inexpensively.

In order to achieve the above objects, a toner cartridge of the present invention comprises a wall that defines an internal space, a displaceable partition that divides the internal space into a first space that may store unused toner, and a second space that may store waste toner, and an agitator that agitates the toner in the first space and may displace the partition by contacting the partition. According to the toner cartridge of the present invention, the agitator, which feeds toner to the external device, may displace the partition.

According to a toner cartridge of the present invention, the partition may be made of a sheet material that may vibrate elastically. Vibration in the partition would unpile a waste toner heap in contact with the partition. According to a toner cartridge of the present invention, the second space may be arranged above the first space. As the first and second spaces are divided by the partition, this configuration allows waste toner to be placed on the partition using gravity. According to a toner cartridge of the present invention, the partition may have a hinge structure. This hinge structure has a simple structure and may displace the partition.

According to a toner cartridge of the present invention, the partition may displace in accordance with an amount of the waste toner, and contact the agitator when the second space stores more than a predetermined amount of the waste toner. The fruitless energy for displacing the partition may thereby be saved where little waste toner exists in the second space.

According to a toner cartridge of the present invention, the partition may have a rigid portion that contacts the agitator. When a portion that contacts that agitator is made rigid, it has high endurance and may reduce an abrasion and breakage due to the contact. According to a toner cartridge of the present invention, the partition has a projection that contacts the agitator. As the partition contacts the agitator at its projection, only the projection is efficiently made durable so as to prevent an abrasion and breakage due to the contact. According to a toner cartridge of the present invention, the second space may be as large as or larger than the first space. This structure prevents the second space from overflowing even when collecting all the toner in the first space. For example, the toner cartridge may be replaced when no toner remains in the first space, and the toner in the first space is effectively utilized.

According to a toner cartridge of the present invention, the wall includes a first opening which is connectable to the first space and openable, and a second opening which is connectable to the second space and openable, the first and second openings being arranged almost symmetrically with respect to the partition. This arrangement is convenient because the displacement of the partition heated at the border between the first and second spaces might easily eliminate a waste toner heap in the second space.

A print unit of the present invention comprises a wall that defines an internal space, a displaceable partition that divides the internal space into a first space that may store unused toner, and a second space that may store waste toner, an agitator that agitates the toner in the first space and may displace the partition by contacting the partition, a photosensitive body, and a development part which forms a predetermined toner image on the photosensitive body. According to the print unit, the agitator, which feeds toner to the external device, may displace the partition.

According to a print unit of the present invention, the partition may be made of a sheet material that may vibrate elastically. Vibration in the partition would unpile a waste toner heap in contact with the partition. According to a print unit of the present invention, the second space may be arranged above the first space. As the first and second spaces are divided by the partition, this configuration allows waste toner to be placed on the partition using gravity. According to a print unit of the present invention, the partition may have a hinge structure. This hinge structure ha a simple structure and may displace the partition.

According to a print unit of the present invention, the partition may displace in accordance with an amount of the waste toner, and contact the agitator when the second space stores more than a predetermined amount of the waste toner. The fruitless energy for displacing the partition may thereby be saved where little waste toner exists in the second space. According to a print unit of the present invention, the partition may have a rigid portion that contacts the agitator. When a portion that contacts the agitator is made rigid, it has high endurance and may reduce an abrasion and breakage due to the contact. According to a print unit of the present invention, the partition has a projection that contacts the agitator. As the partition contacts the agitator at is projection, only the projection is efficiently made durable so as to prevent an abrasion and breakage due to the contact.

According to a print unit of the present invention, the second space may be as large as or larger than the first space. This structure prevents the second space from overflowing even when collecting all the toner in the first space. For example, the toner cartridge may be replaced when no toner remains in the first space, and the toner in the first space is effectively utilized.

A storage device of the present invention comprises a wall that defines as internal space, a displaceable partition that divides the internal space into first and second spaces, and a processing member which performs a predetermined process in the first space, wherein power supplied to said processing member is partially utilized to make the processing member contact the partition and displace said partition. According to the storage device, the power supplied to the processing member may displace the partition via the processing device or other members, and the processing member may perform a predetermined process. The power originally to the processing device also serves to displace the partition.

A method of manufacturing a storage container of the present invention comprises the steps of forming a processing member, first and second walls, and a displaceable partition, aligning the first and second walls and partition with one another while storing the processing member in the first wall, and adhering the first wall, second wall and partition around the partition, wherein the processing member performs a predetermined process in a space defined by the first wall and partition and power supplied to the processing member is partially utilized to make the processing member contact the partition and displace the partition. This method manufactures the storage container forming and adhering three layers. This adhesion may use ultrasound and/or heat.

A printer of the present invention comprises a wall that defines an internal space, a displaceable partition that divides the internal space into a first space that may store unused toner, and a second space that may store waste toner, an agitator that agitates the toner in the first space and may displace the partition by contacting the partition, a photosensitive body, a development part which forms a predetermined toner image on the photosensitive body, and a transfer device which transfers the toner image on a printing paper. According to this printer, the agitator, which feeds toner to the development part, may displace the partition.

Other objects and further features of the present invention will become readily apparent from the following description and accompanying drawings.

DETAILED DESCRIPTION OF PREFERRED EMBODIMENTS

Figure 1:
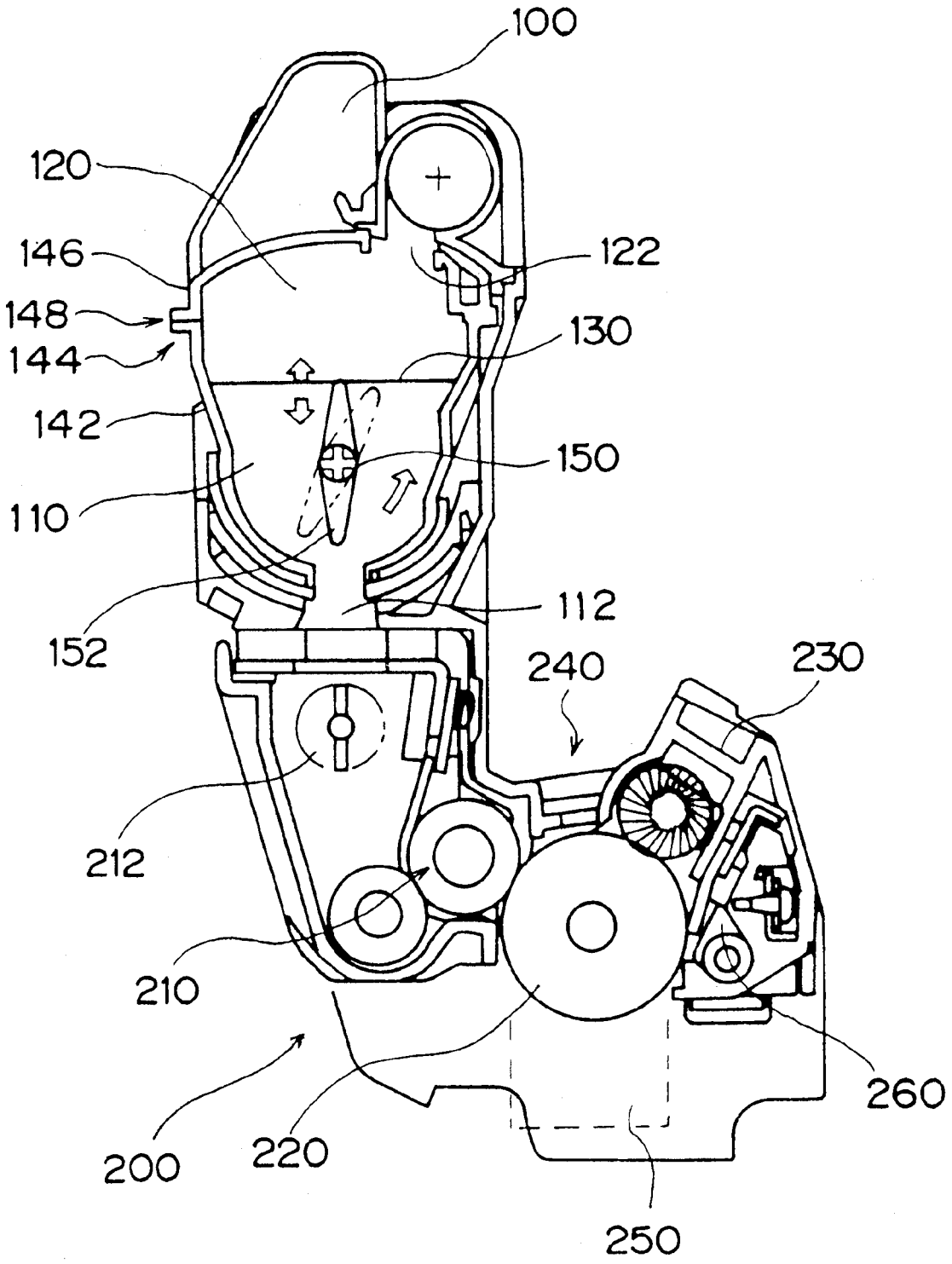
FIG. 1 is a principal longitudinal section for explaining a structure of a toner cartridge of this invention.

A description will now be given to a toner cartridge 100 of the present invention, with reference to FIGS. 1 through 5. Those elements in each drawing which are designated by the same reference numeral denote the same elements, and a duplicate description thereof will be omitted. Those elements designated by the same reference numeral with a variety of alphabetical letters generally denote variations, and a reference numeral having no alphabetical letter generalizes all the corresponding reference numerals having alphabetical letters unless otherwise specified. Hereupon, FIG. 1 is a principal longitudinal sectional view of the toner cartridge 100. The toner cartridge 100 serves to store and feed development toner and collect waste toner. Optionally, was toner may possibly be mixed with development toner for recycle, but the present embodiment disposes of the waste toner to prevent deterioration in printing quality by reusing the toner worse than development toner.

The toner cartridge 100, which is a separate body from and loaded into a print unit 200, comprises a storage space 110 for development toner, a storage space 120 for waste toner, a partition sheet 130, walls 142 and 146, and an agitator 150. The wall 142 and partition sheet 130 define the storage space 110, while the wall 144 and partition sheet 130 define the storage space 120. The storage space 110 is connected with a development-toner inlet 112, whereas the storage space 120 has a waste-toner outlet 122. The inlet 112 and outlet 122 are both made open when the toner cartridge 100 is loaded into the print unit 200.

Figure 2:
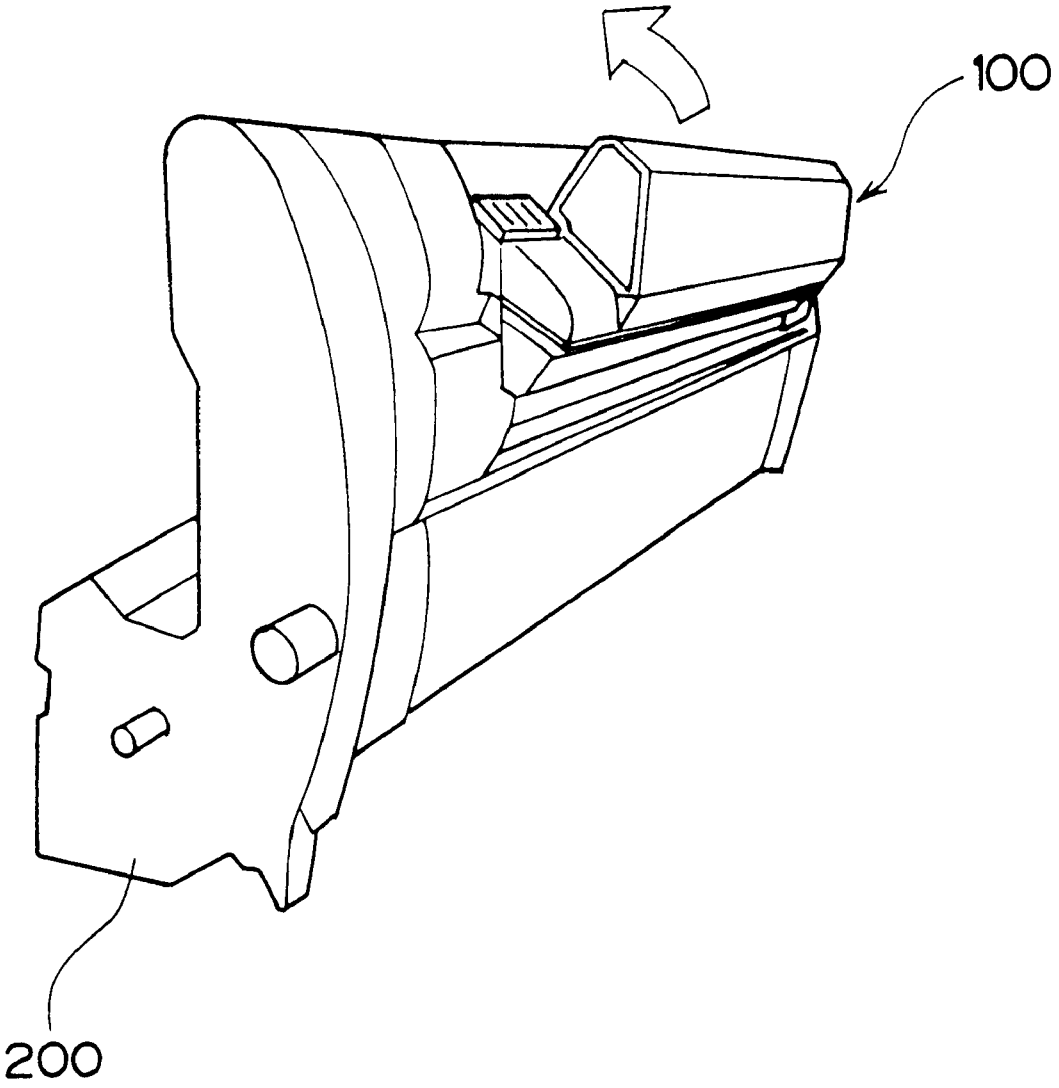
FIG. 2 is a perspective view of the toner cartridge shown in FIG. 1 inserted but not loaded into a print unit.
Figure 3:
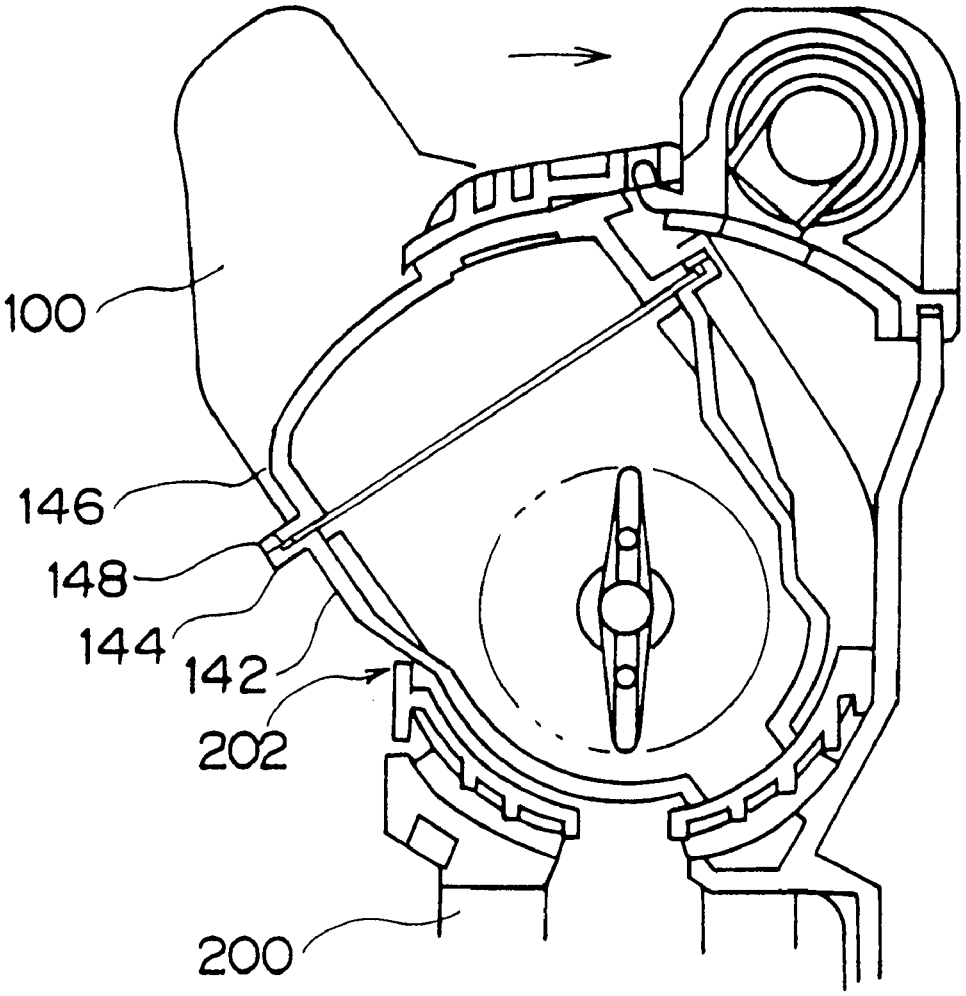
FIG. 3 is a cross sectional view of the state shown in FIG. 2.
Figure 4:
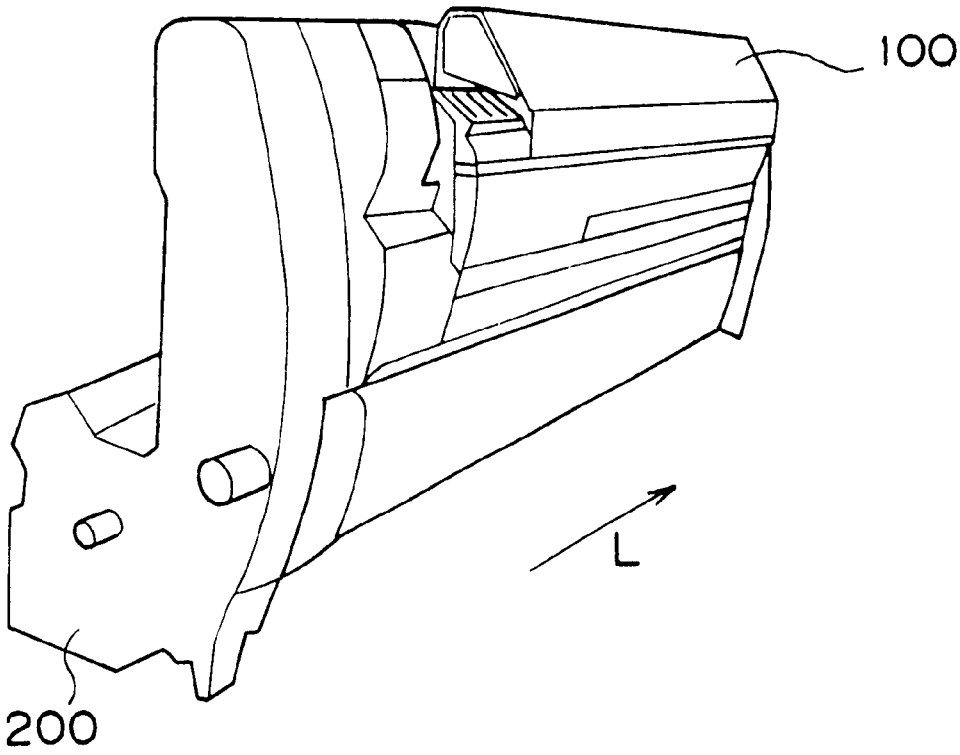
FIG. 4 is a perspective view of the toner cartridge loaded into the print unit.
Figure 5:
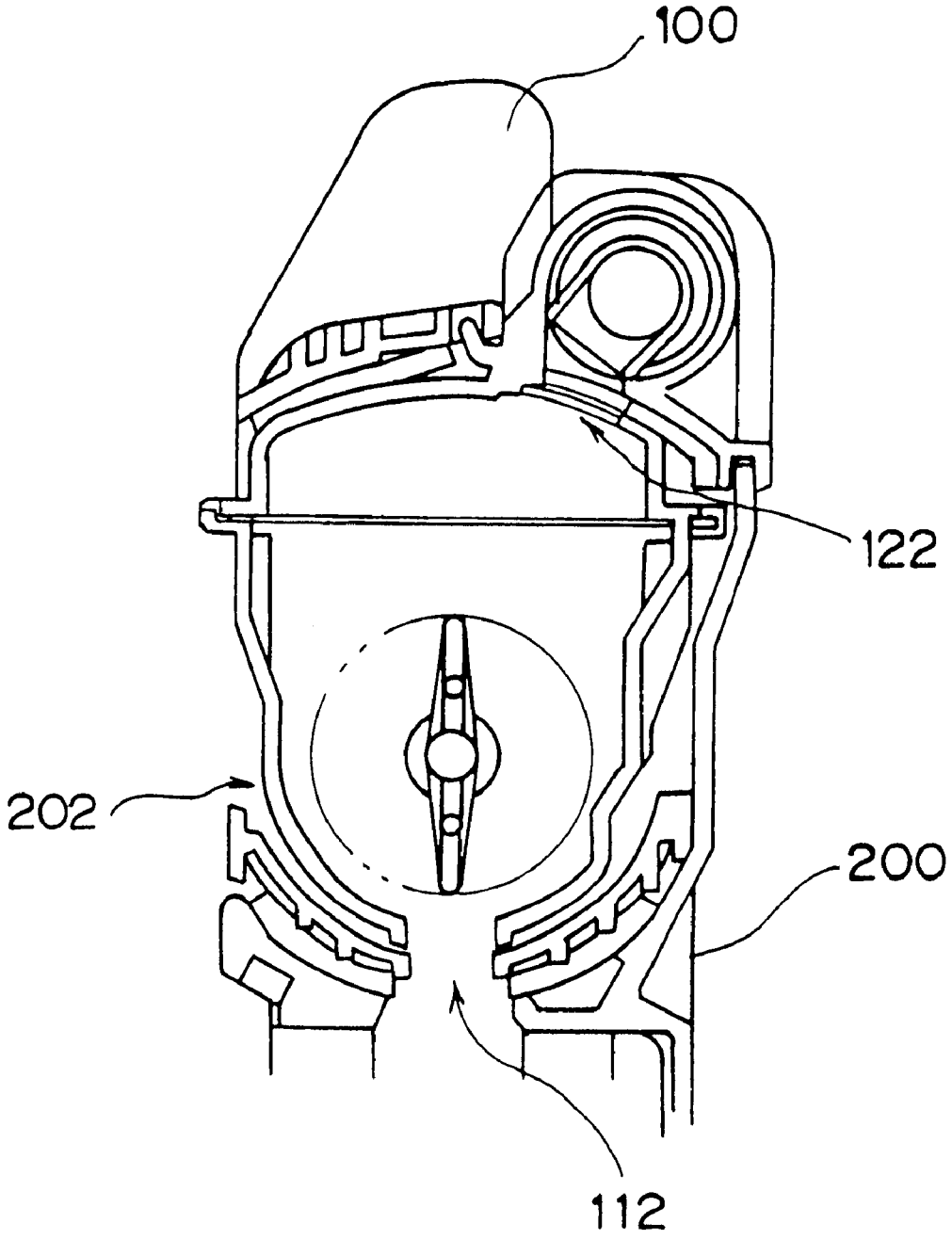
FIG. 5 is a cross sectional view of the state shown in FIG. 4.

Referring to FIGS. 2 through 5, a description will be given to a loading of the toner cartridge 100 into the print unit 200. FIG. 2 is a perspective view of the toner cartridge shown in FIG. 1 inserted but not loaded into a print unit. FIG. 3 is a cross sectional view of the state shown in FIG. 2. FIG. 4 is a perspective view of the toner cartridge loaded into the print unit by rotating the toner cartridge shown in FIG. 2 in the arrow direction. FIG. 5 is a cross sectional view of the state shown in FIG. 4. The toner cartridge 100 is thus inserted into an opening 202, rotated there, and loaded in the print unit 200.

Referring now to FIG. 1, the storage space 110 contains development toner. The development toner may consist of a single component (i.e., toner only), or a plurality of components (e.g., a mixture of toner and carrier). However, in the following description, "toner" generally denotes both of them for description convenience. It is to be understood that the development toner is not limited to black toner but applicable to multi-color toner (yellow, cyan and magenta).

The storage space 120 is characteristically provided above the storage space 110. If the storage spaces 110 and 120 are aligned with each other in direction L and divided by a partition in FIG. 4, only a displacement of the partition would not level waste toner stored in the space 120 as will be described later. Accordingly, it is preferable to place the storage space 120 above the storage space 110.

Figure 6:
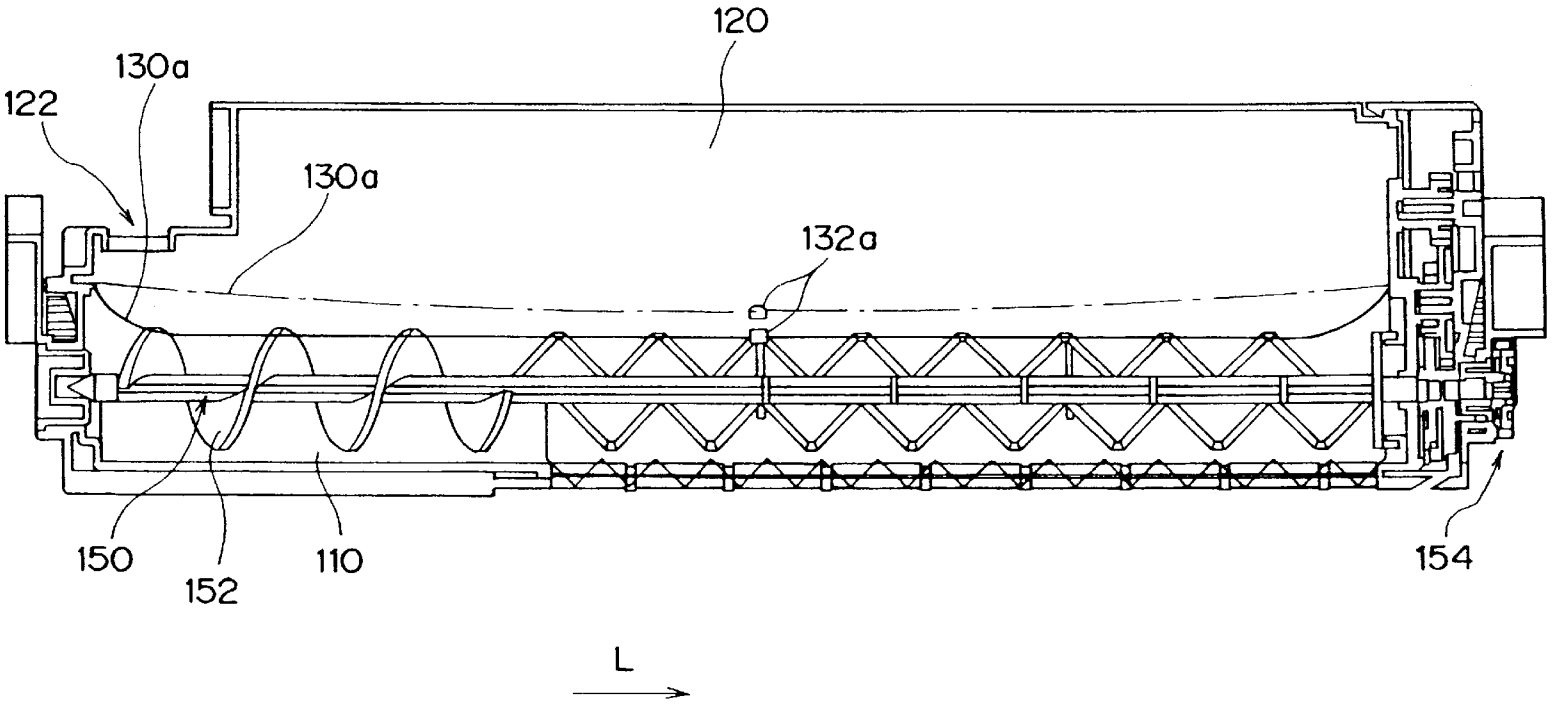
FIG. 6 is a cross sectional view showing a variation of the toner cartridge shown in FIG. 1.

The agitator 150 is provided in the storage space 110, and serves to facilitate, as seen in a conventional device, toner in the storage space 110 to be supplied to a development part 210 in the print unit 200 which will be described later. The present embodiment is designed to make the most of the storage space 120 using this conventional member as it is, to displace the partition sheet 130 and level waste toner in the storage space 120. This embodiment thus needs no additional agitator in the storage space 120, simplifying its structure. Referring to FIG. 6, the agitator 150 has a helical rotary arm 152. FIG. 6 is a cross sectional view showing the structure of the toner cartridge 100. As seen in FIG. 6, upper and lower rotary arms 152 are staggered. However, any structure known in the art is applicable to the agitator 150.

The partition sheet 130 serves to partition the storage spaces 110 and 120. The storage space 120 is designed to be as large as or larger than the storage space 110. Accordingly, if all toner in the storage space 110 were disposed of, the storage space 120 would store it.

The partition sheet 130 may have some variations in structure and arrangement. The partition sheet 130 shown in FIG. 1 is made of resin (e.g., polyester or polyethylene) having a uniform thickness of 0.1 mm through 0.3 mm. The partition sheet 130 may use any material as far as it is predetermined elasticity. Moreover, the partition 130 in FIG. 1 is so positioned that it may intermittently contact the rotary arm 152 in the agitator 150; therefore, the partition sheet 130 is positioned inside the lower wall 142. On the other hand, as will be explained later, the partition sheet 130 may be positioned on the border between the lower and upper walls 142 and 146, or inside the upper wall 146. The partition sheet 130 vibrates by its elasticity whenever it contacts the rotary arm 152 in the agitator 150. The agitation, as will be described later, would level waste (or disposal) toner collected and supplied through the outlet 122.

Figure 7:
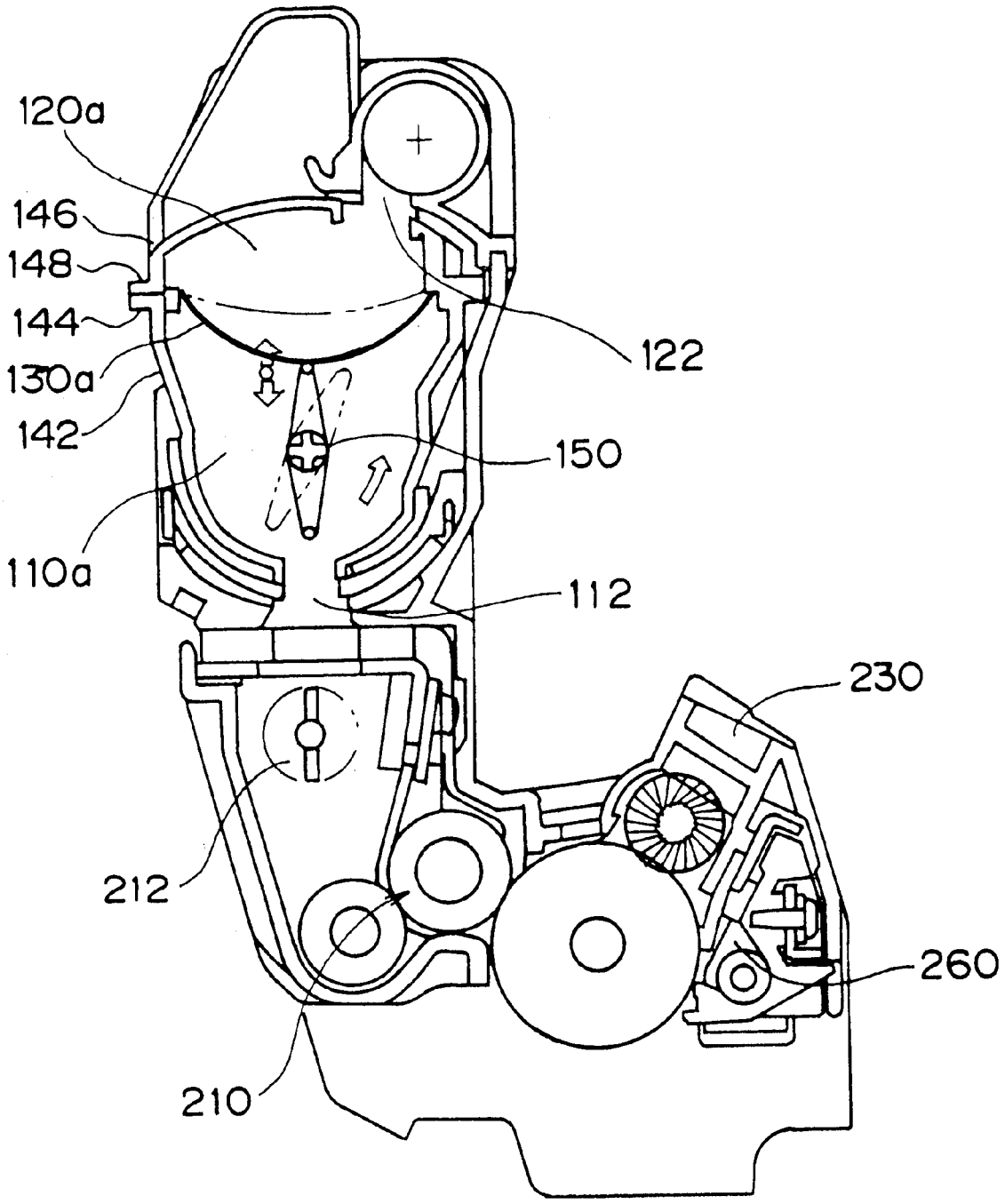
FIG. 7 is a longitudinal section of the toner cartridge shown in FIG. 6.

Alternatively, the partition sheet 130 may be replaced with a partition sheet 130*a*. The partition sheet 130*a* does not contact the agitator 150 at an initial state as shown by a broken line in FIGS. 6 and 7, whereas it bends down when receiving a predetermined amount (weight) of toner and contacts the agitator 150 as shown by a solid line in FIG. 7. Referring to FIG. 6, the offset arrangement of the upper and lower rotary arms 152 would prevent only one part of the partition sheet 130 from contacting the agitator 150 and being worn out or otherwise. The partition sheet 130*a* in FIG. 6 may have a weight 132*a* at its center and incline from the periphery to the center. This configuration facilitates toner injected from the outlet 122 to the sheet 130 to move to the center of the sheet, preventing the toner from accumulating in a heap below the outlet 122. As shown in FIG. 7, the partition sheet 130*a* is provided on the border between the walls 142 and 146, and sandwiched between their gaskets 144 and 148. The storage space 110*a* is broader than the storage space 110 shown in FIG. 1.

Figure 8:
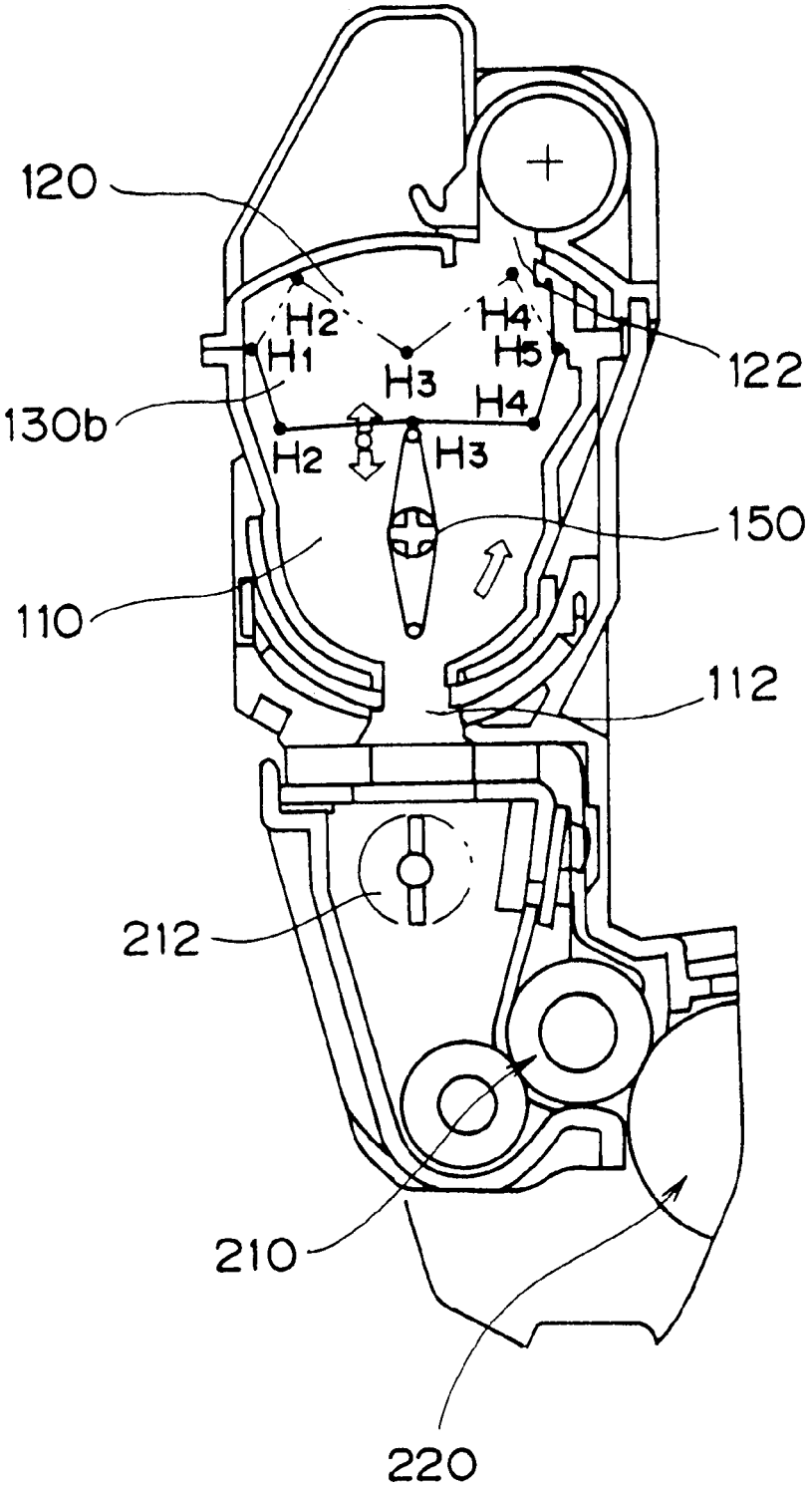
FIG. 8 is a longitudinal section for explaining a variation of the toner cartridge shown in FIG. 1.

As shown in FIG. 8, the partition sheet 130 may be replaced with a partition sheet 130*b* that has a hinged structure comprising a plurality of hinges $H_1$ through $H_5$. In FIG. 8 similar to FIG. 7, the partition sheet 130*b* is provided on the border between the walls 142 and 146, and sandwiched between their gaskets 144 and 148. The partition sheet 130*b* may be placed so that it does not contact the agitator 150 at an initial state as shown by a broken line in FIG. 8, whereas it moves down when receiving a predetermined amount (weight) of toner and contacts the agitator 150 as shown by a solid line in FIG. 8. The hinge $H_3$ may have a projection (which is made, for instance, of a tubular rigid member) for connection with the agitator 150. This configuration efficiently enables only the enhanced endurance in the hinge $H_3$ to prevent an abrasion and breakage of the partition sheet 130*b* through contact with the agitator 150 instead of enhancing endurance in the entire partition sheet 130.

Each hinge $H_1$ through $H_5$ may be exemplarily configured as a tubular rigid member extending in the longitudinal direction, and the partition sheet 130*b* may be configured by rotatably inserting these tubular rigid members between two polyester sheets. Alternatively, connection members between hinges $H_1$ through $H_5$ may be configured as a rigid member, because the partition sheet 130*b* is displaceable by the hinge structure without a need of elastic deformation. For example, a rigid member may be set between hinges $H_2$ and $H_3$ or between hinges $H_3$ and $H_4$, or adhered to a polyester sheet. The enhanced endurance in the partition sheet 130*b* using a rigid member would prevent an abrasion and breakage caused by a contact with the agitator 150. Affixing a rigid member to the center of the partition sheet 130*b* would make the center heavier and effectively prevent toner from accumulating in a heap just below the outlet 122.

The toner cartridge 100 is made by vertically connecting two walls 142 and 146 made of plastics, etc., to each other using the gaskets 144 and 148. Any connection method known in the art such as screwing, bonding, etc. is applicable to the connection at the gaskets 144 and 148, and a detailed description thereof will be omitted.

The agitator 150 is conventionally provided in the toner cartridge 100, geared at an end portion 154 shown in FIG. 6, and powered by the print unit 200. Thus, a detailed description on the structure and functions of the agitator 150 will be omitted here. The agitator 150 originally serves to assist toner in the storage space 110 in being supplied to the development part 210 in the print unit 200. This embodiment, however, uses this conventionally provided agitator 150 to vibrate the partition sheet 130, and thereby level the toner in the storage space 120. Although the agitator 150 directly contacts the partition sheet 130 in this embodiment, this invention covers those which vibrate the partition sheet 130 utilizing power conventionally supplied to the toner cartridge 100. For instance, the agitator 150 may be equipped with another rotary member that rotates coaxial with the rotary arm 152 and vibrates the partition sheet 130.

The print unit 200 comprises the development part 210, a photosensitive drum 220, pre-charger device 230 and a cleaning portion 260. The photosensitive drum 220 when loaded into a printer which will be explained later would face a transfer unit 250. Similarly, an optical system 240 which can irradiate an exposure laser beam would face the photosensitive drum 220. Any structure known to those skilled in the art is applicable to these elements, and a detailed description of each element will be omitted. An entire print operation and toner collection will be discussed later.

Figure 9:
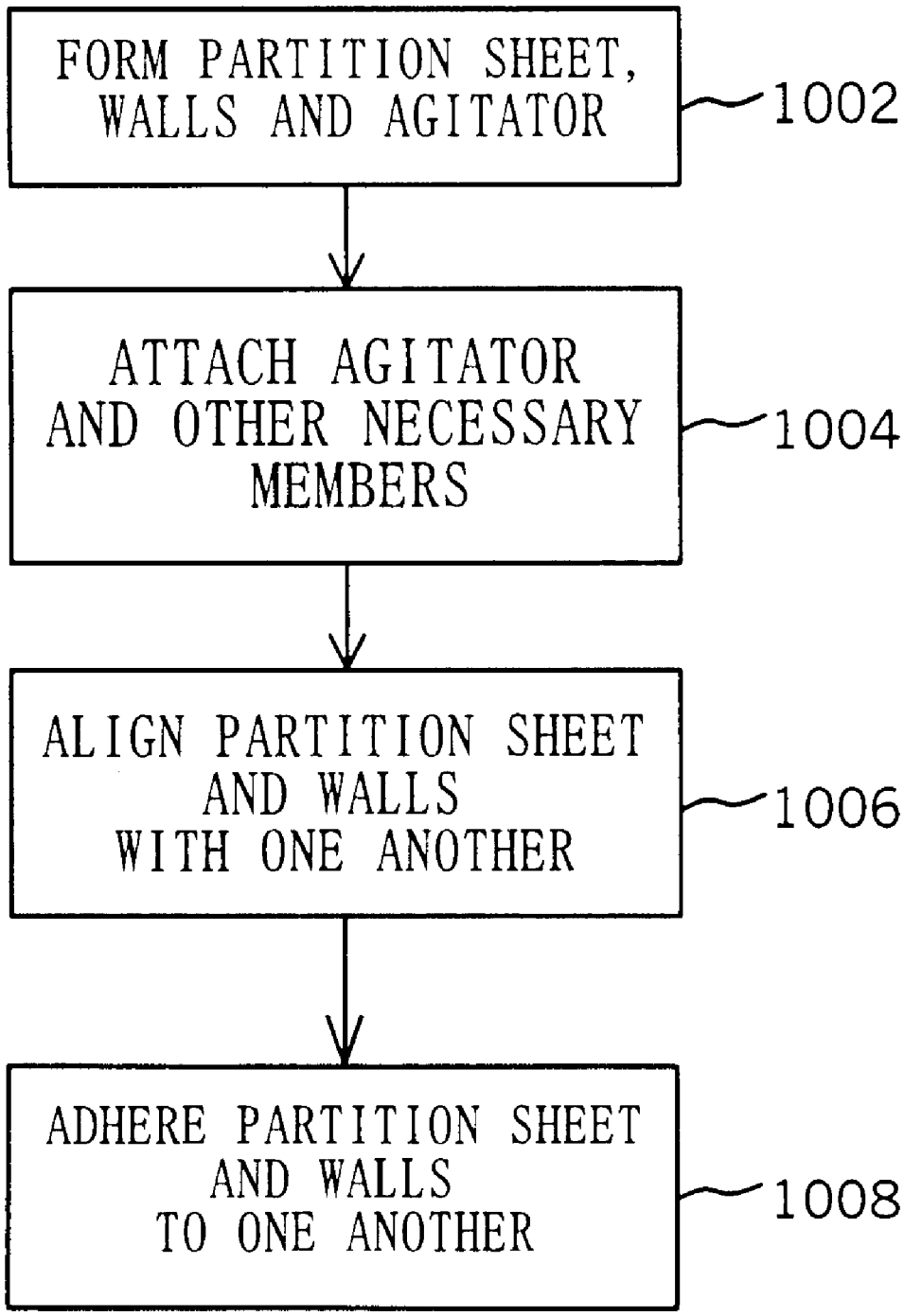
FIG. 9 is a flowchart that illustrates a manufacturing method of the toner cartridge of this invention.

Referring next to FIG. 9, a description will be given of an attachment method of the partition sheet 130. In the following description, the partition sheet 130 generalizes partition sheets 130*a,* 130*b,* etc. First, the partition sheet 130, two walls 142 and 146, and agitator 150 are formed (step 1002). The partition sheet 130 may vary in size according to its attachment position. Next, the agitator 150 is attached to a predetermined position inside the lower wall 142 and other required mechanisms are also installed (step 1004).

The partition sheet 130 and walls 142 and 146 are aligned with one another (step 1006). In an attempt to place the partition sheet 130 on the border between the walls 142 and 146, the partition sheet 130 is located at the gaskets 144 and 148. In an attempt to place the partition sheet 130 inside the lower wall 142, the partition sheet 130 may be located between the two parts into which the lower wall 142 is divided further.

The partition sheet 130 and walls 142 and 146 are then bonded (step 1008). This step may utilize screws or adhesives, or ultrasound and/or thermal adhesion of the partition sheet to the wall 142 and/or 146. If necessary, the partition sheet 130 and wall 142 and/or 146 are then sealed.

Figure 10:
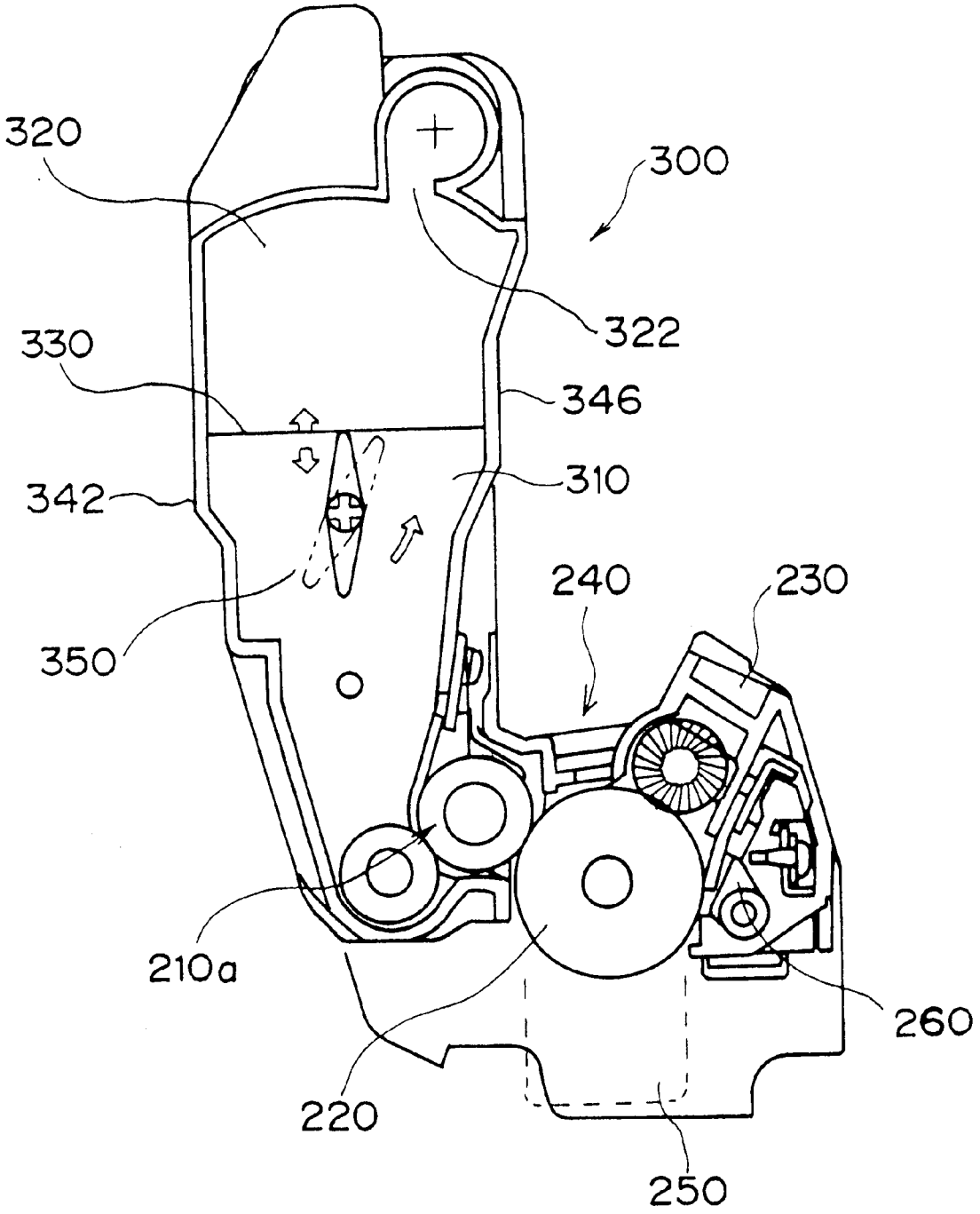
FIG. 10 is a principal longitudinal section that illustrates a structure of the print unit of the present invention.
Figure 11:
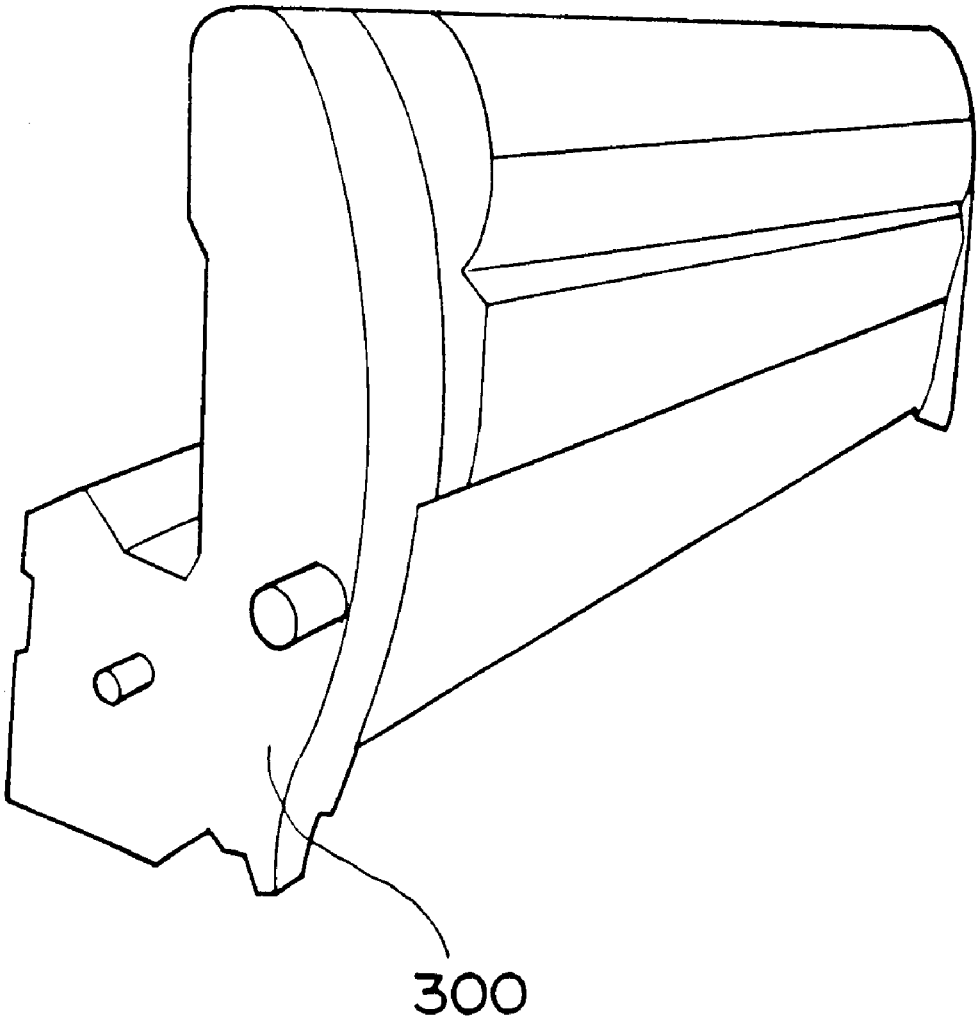
FIG. 11 is a schematic perspective view of the print unit shown in FIG. 11.

A description will now be given of the print unit 300 of the present invention with reference to FIGS. 10 and 11. FIG. 10 is a longitudinal section for explaining a structure of the print unit 300, whereas FIG. 11 is a schematic perspective view of the print unit 300. The print unit 300 undetachably integrates the toner cartridge 100 and print unit 200 and is also called a print cartridge. An internal structure of the print unit 300 is similar to that of the print unit 300 loading the toner cartridge 100 shown in FIG. 1. However differently, the print unit 300 has only one agitator 350, whereas the structure shown in FIG. 1 provides the toner cartridge 100 with the agitator 150 and the print unit 200 with the generator 212.

The print unit 300 comprises a storage space 310 for development toner, a storage space 320 for waste toner, a partition sheet 330, walls 342 and 346, and an agitator 350. The agitator 350 corresponds to the agitator 150, and a detailed description thereof will be omitted. The walls 342 and 346 are, for example, cut off at a position where the partition sheet 330 is located, and sandwiched the partition sheet 330. The structure in FIG. 10 may be manufactured by the same steps as explained with reference to FIG. 9. The structure and arrangement of the partition sheet 330 may change it structure and arrangement as the partition sheet 130.

A description will next be given of a toner collection operation when the print unit 200 loads the toner cartridge 100 and/or the print unit 300 is loaded into a printer 10, with reference to FIGS. 12 through 18.

Figure 12:
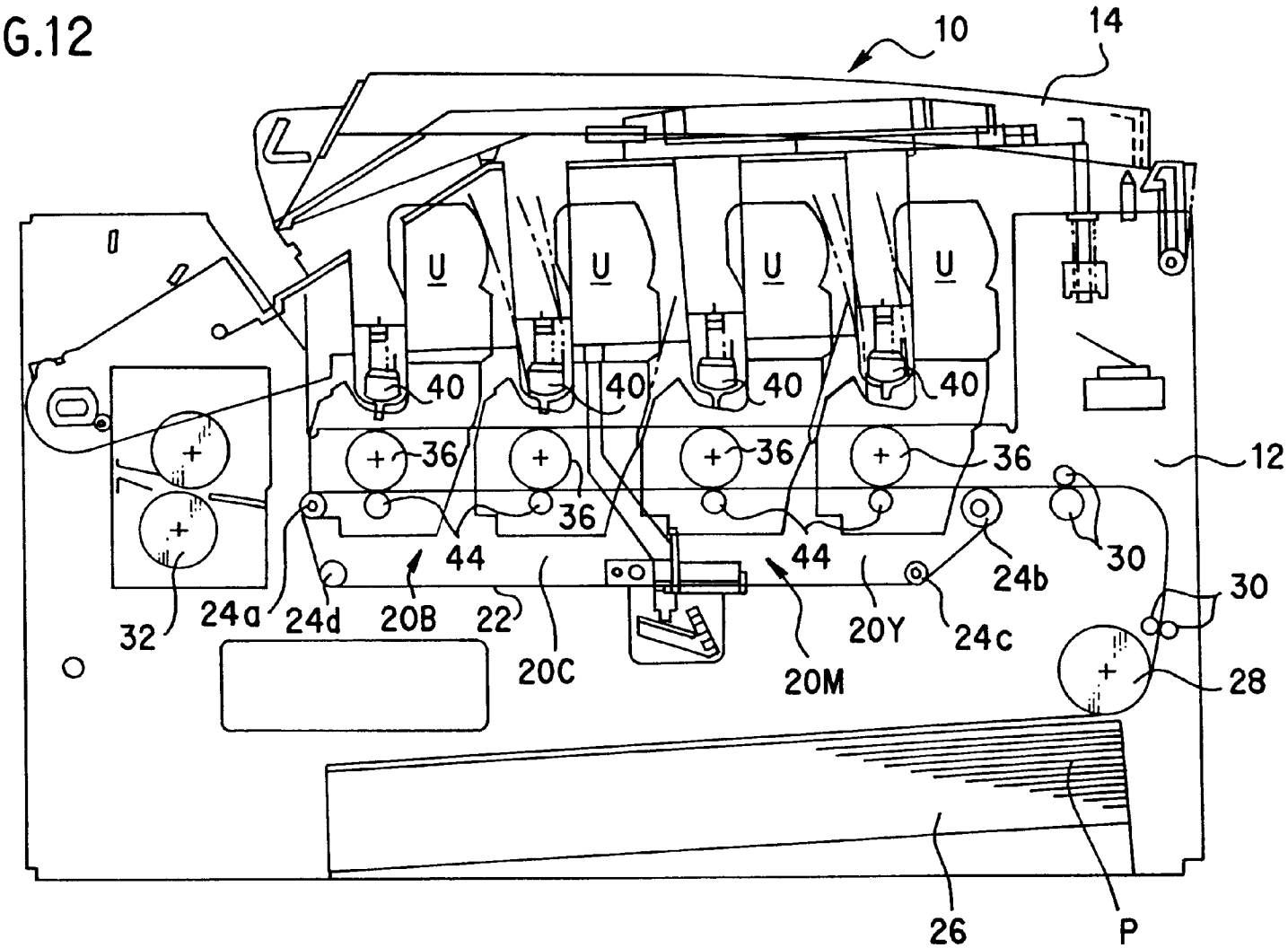
FIG. 12 is a schematic side view showing an image-forming device with a top cover located at a slightly open position of an embodiment according to the present invention.
Figure 13:
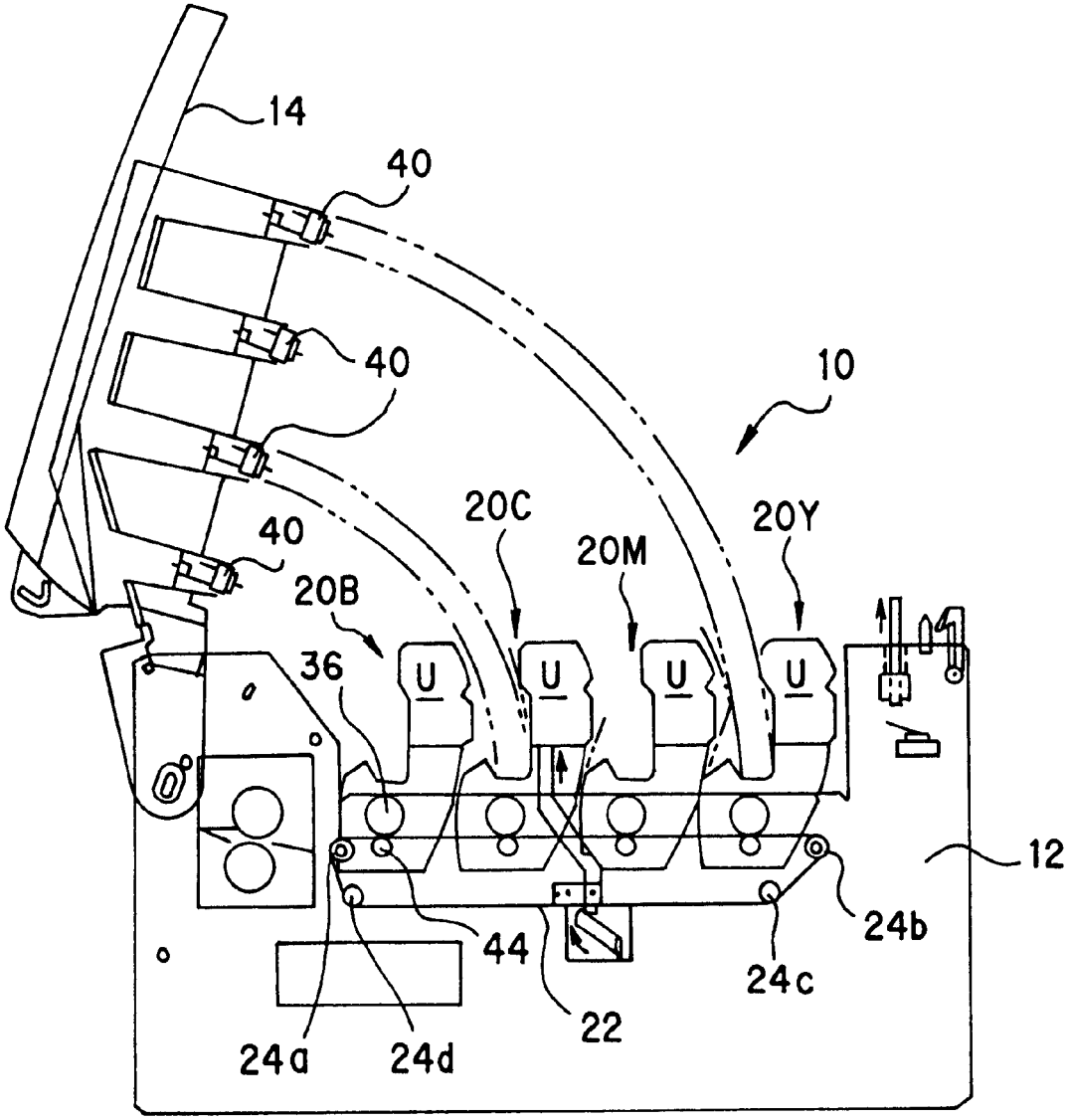
FIG. 13 is a view of the image-forming device with the top cover located at a fully open position.

FIGS. 12 and 13 are each a view showing an image forming device 10 of one embodiment according to the present invention. This image-forming device 10 is configured as a full color printer. The image-forming device 10 includes a frame 12, and the frame 12 includes a top cover 14 and a rear cover 16. The rear cover 16 is omitted in FIGS. 12 and 13 but shown in FIGS. 15 and 16. FIG. 12 illustrates a state in which the top cover 14 opens slightly with respect to the frame 12. FIG. 13 illustrates a state in which the top cover 14 opens fully with respect to the frame 12. Opening the top cover 14 and/or rear cover 16 would provide an access to members in the image-forming device 10.

Figure 15:
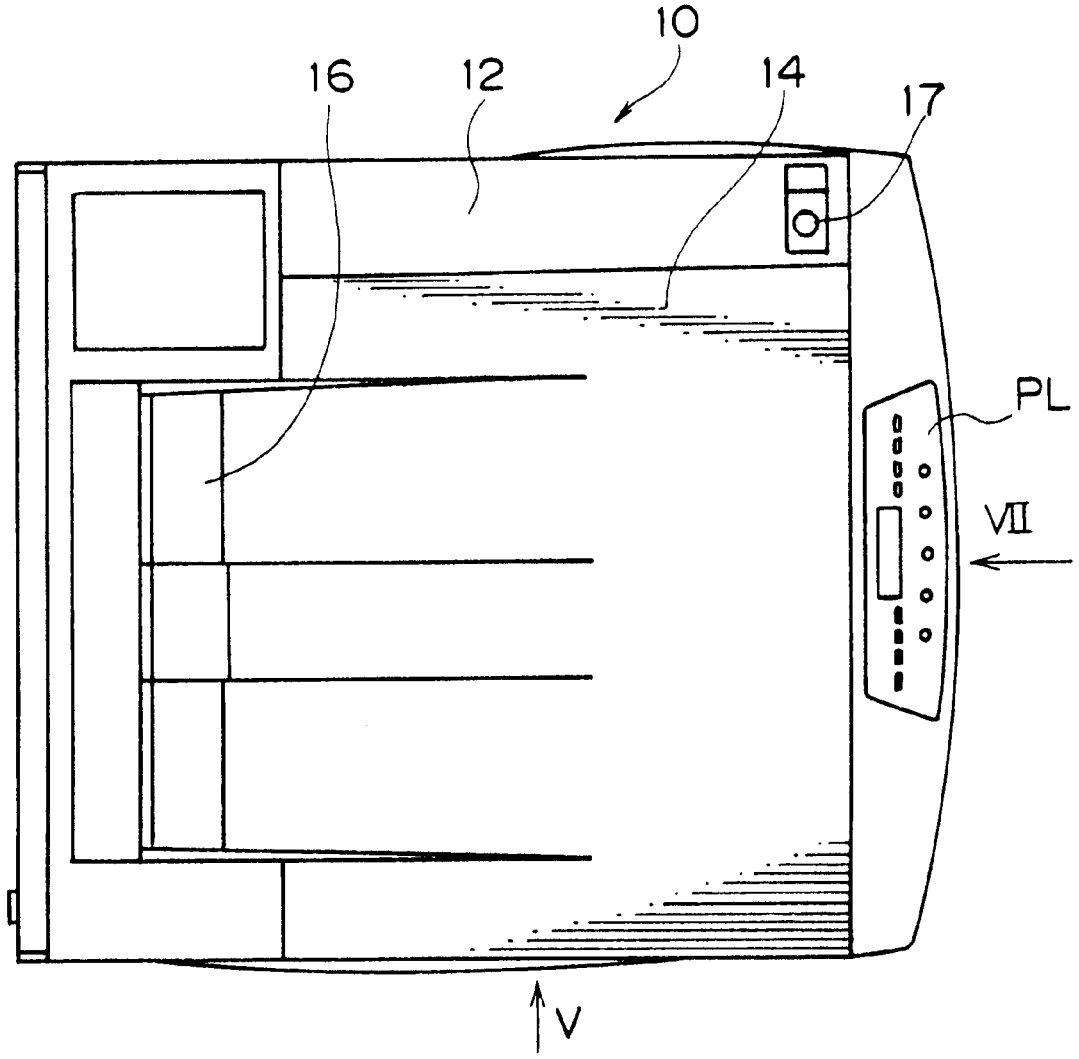
FIG. 15 is a plan view of the image-forming device with a top cover located at a closed position.
Figure 16:
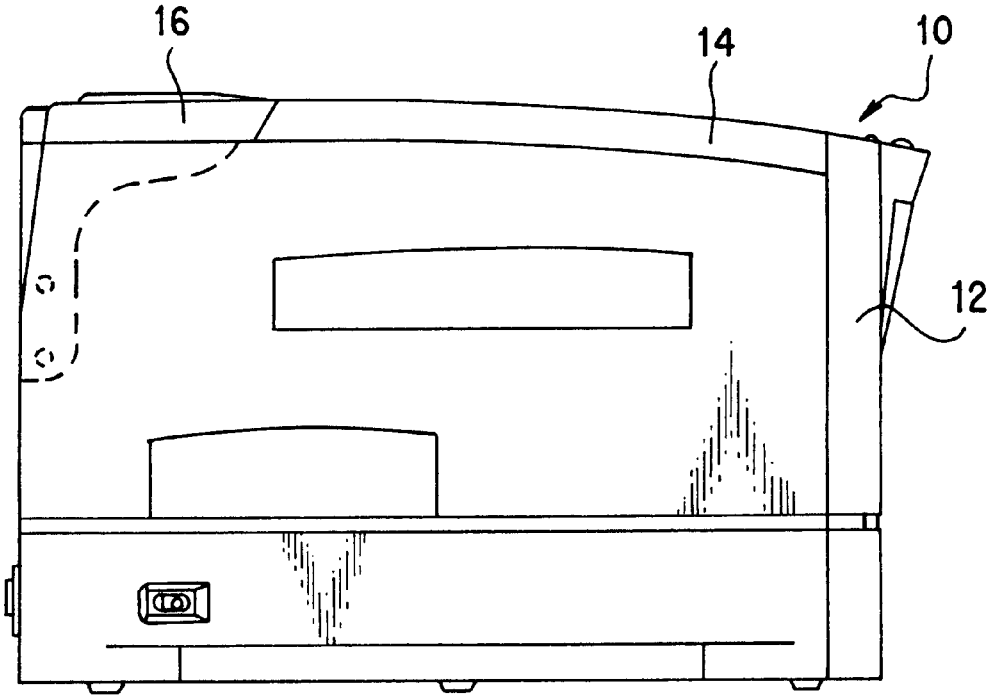
FIG. 16 is a side view of the image-forming device shown in FIG. 4.

FIG. 15 is a plan view of the image-forming device 10 with the top cover 14 closed with respect to the frame 12. FIG. 16 is a side view of the image-forming device 10 shown in FIG. 15. The image-forming device 10 includes an operation panel PL at a right end in FIG. 15. In the drawings, the right end having the operation panel PL is a front side, and the left end portion is a rear side. On the front side of the device are provided an unlock button 17 for the top cover 14. The rear cover 16 is provided on an end opposite to the operation panel PL.

In FIGS. 12 and 13, the image-forming device 10 has four print units 20B, 20C, 20M and 20Y placed in series, and the aforementioned print unit 200 provided with the toner cartridge 100 and the print unit 300 are applicable to each of these units. A free-end paper conveyer belt 22 is provided to these four print units 20B, 20C, 20M and 20Y. The paper conveyer belt 22, which is made of suitable synthetic resin, is looped around four rollers 24*a,* 24*b,* 24*c* and 24*d.* The roller 24*a* is a drive roller and also serves as an AC discharge roller that removes electric charges from the paper conveyer belt 22. The roller 24*b* is a subroutine roller and also serves as a charge roller that charges the paper conveyer belt 22. Each of the rollers 24*c* and 24*d* is a guide roller. The roller 24*d* is a tension roller that generates a proper tension to the paper conveyer belt 22.

Below the paper conveyer belt 22 is provided a hopper 26. A batch of paper P is accumulated in the hopper 26. Each sheet of paper is picked by a pick roller 28 and conveyed to the paper conveyer belt 22 by paper feed rollers 30. A sheet of paper P is conveyed by the paper conveyer belt 22 to the print units 20B, 20C, 20M and 20Y, and printed or recorded. The recorded paper is conveyed to a fixer 32 and ejected through a proper guide roller (not shown) to a stacker at the top of the top cover 14.

The paper conveyer belt 22 is charged by the subordinate roller 24*b;* when the paper P is fed from the subordinate roller 24*b* to the paper conveyer belt 22, the paper P is electrostatically adhered to the paper conveyer belt 22. Accordingly, the paper P is kept in place relative to the paper conveyer belt 22. As the drive roller 24*a* serves as a discharge roller, the paper P is discharged when passing through the driver roller 24*a,* and easily separated from the paper conveyer belt 22 without tangling with a lower transport portion in the paper conveyer belt 22 while being ejected from the drive roller 24*a.*

The four print units 20Y, 20M, 20C and 20B have the same structures and store developing agents having respectively yellow, magenta, cyan and black toner components. Accordingly, these print units 20Y, 20M, 20C and 20B respectively print yellow, magenta, cyan and black toner images on the moving paper P that is held on the paper conveyer belt 22, thereby forming a full-color image on it.

Figure 14:
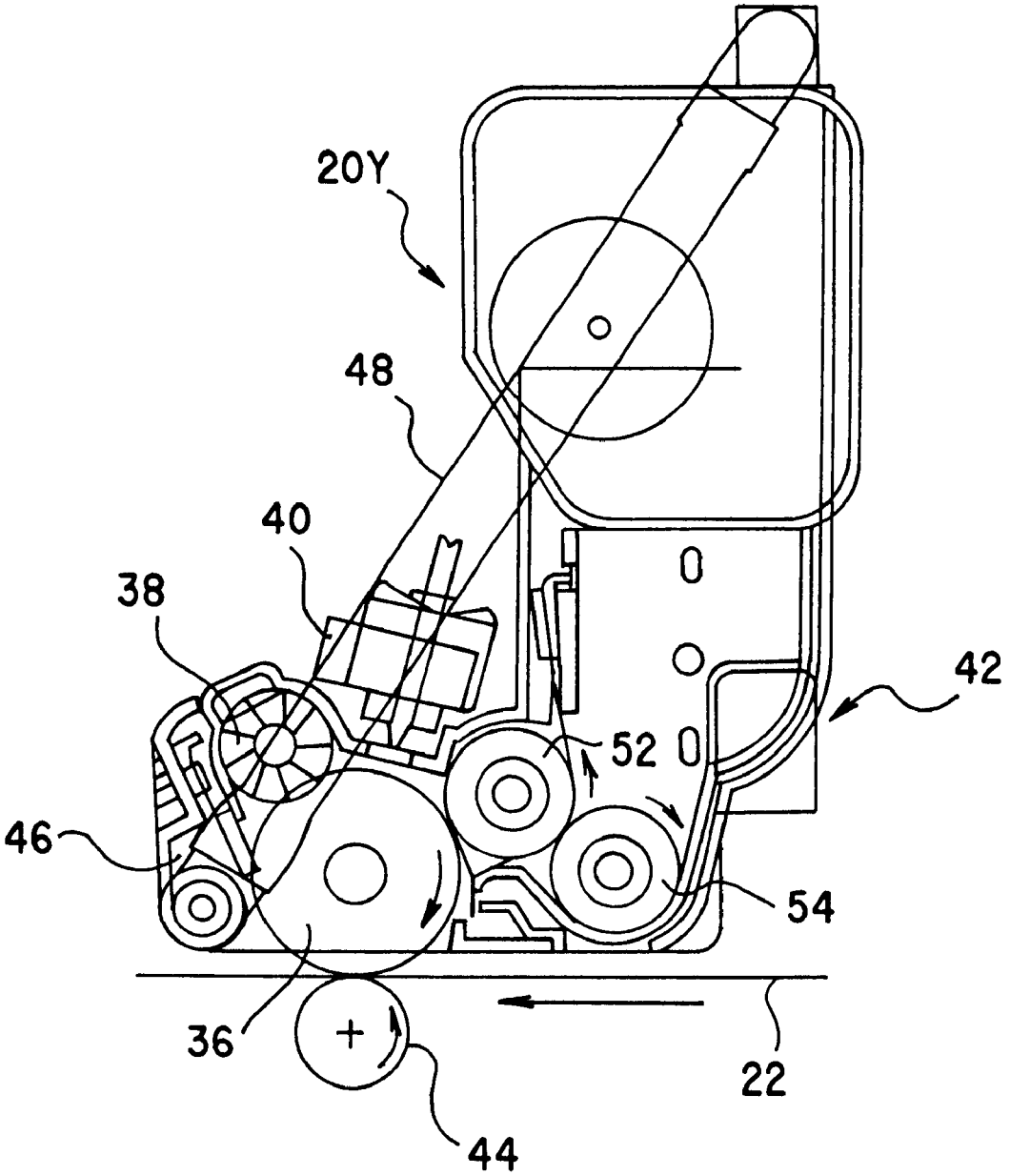
FIG. 14 is a view showing one print assembly.

FIG. 14 shows one print unit 20Y. The print unit 20Y comprises a photosensitive drum 36 corresponding to the photosensitive drum 220 shown in FIG. 1 and rotatable in the arrow direction in FIG. 13, a pre-charger device 38 corresponding to the pre-charger device 230 shown in FIG. 1, an optical head (LED beam scanner) 40 corresponding to the optical system 240 system in FIG. 1, a development device 42 corresponding to the development part 240 shown in FIG. 1, a transfer roller 44 which is a part of the transfer unit 250 shown in FIG. 1 and a toner cleaner 46 corresponding to the cleaning portion 260 shown in FIG. 1.

The pre-charger device 38 is configured for example as a brush charger, roller charger or corona charger, and the photosensitive body 36 is sequentially charged on its surface with uniform electric charges by the pre-charger device 38. The optical head 40 is arranged subsequent to the pre-charger device 38 and writes an electrostatic latent image on a charged area of the photosensitive body 36 using an LED beam. The LED beam is flashed based on image data obtained from a computer and word processor, etc. so that the electrostatic latent image is written down as a dot image.

The electrostatic latent image written down on the photosensitive drum 36 is electrostatically developed as a charged toner image using predetermined color toner from the development device 42. Then, the charged toner image is electrostatically transferred on the paper P by transfer element 44 under the photosensitive body 36. The transfer element 44 is formed as a conductive transfer roller made of a porous member (sponge). The transfer element 44 is pressed by the paper conveyer belt 22 against the photosensitive body 36, and applies an electric charge having a polarity reverse to the charged toner to the paper P conveyed by the paper conveyer belt 22, thereby the charged toner image on the photosensitive body 36 is electrostatically transferred on the paper P.

Figure 17:
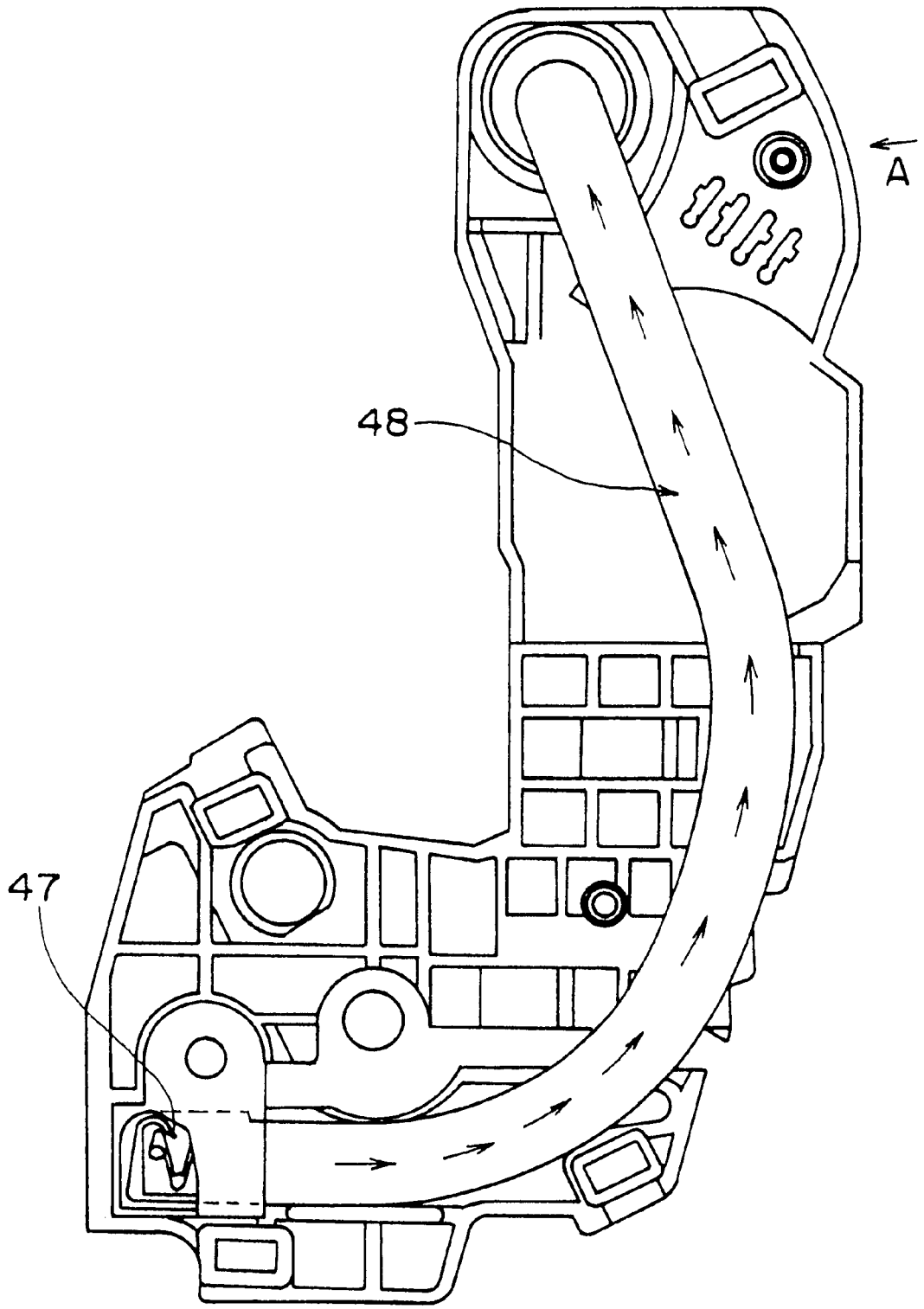
FIG. 17 is a partial section for explaining waste toner collection.
Figure 18:
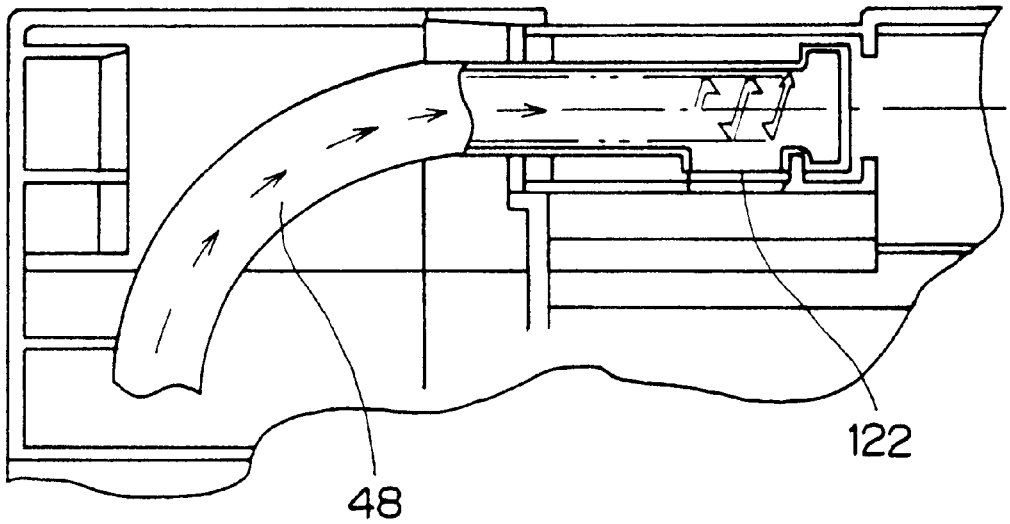
FIG. 18 is a partial section of FIG. 17 viewed from direction A.

The paper P on which the charged toner image is transferred is released from the paper conveyer belt 22 and moves to the fixer 32. Untransferred toner remains on a surface of the photosensitive body 36 that completes a transfer onto the paper P. The toner cleaner 46 removes this remaining toner. The removed toner is returned to the above storage space 120 or 320 by a feed screw 47 and hose 48 (FIG. 17).

The development part 42 installed in the unit would face a surface of the development roller 52, namely a carrier that carries an electrostatic latent image on the photosensitive drum 36. A developing agent reservoir exists at the bottom of the print unit 20Y and includes a reset roller 54. The reset roller 54 rotates in the arrow direction in the drawing when the development part 42 operates. The reset roller 54 collects the developing agent that has not been fed to the photosensitive drum 36 and remained on the development roller 52.

The developing agent is conveyed by a rotation of the development roller 52 to an area opposite to the photosensitive drum 36, namely the development area. In order to restrict an amount of the developing agent to a predetermined amount, a developing agent regulation blade (not shown) is provided opposite to the development roller 52.

When toner is, for example, negatively charged on the development part 42 the pre-charger device 38 has formed a uniform negative charged area on the rotary surface of the photosensitive drum or body 36. An LED beam irradiated on to the charged area on the photosensitive body 36 from the optical head 40 would release negative charges and create a potential difference. An electrostatic latent image is written down as a potential difference onto the charged area of the photosensitive drum 36. For example, when the charged area of the photosensitive drum 36 has a potential of −600 volts, a potential of the electrostatic latent image reduces down to about −50 volts. A negative development bias voltage, for example, of −400 volts is applied to the development roller 52, and an electric field is created between the development roller 52 and photosensitive drum 36. The negatively charged toner is moved to the photosensitive drum 36 by the electric field between the development roller 52 and photosensitive drum 36, and adhered and developed onto the photosensitive drum 36.

According, four-color toner images overlap each other and form a full color image on the paper P when it moves as shown in FIG. 12, from the subordinate roller 24*b* of the paper conveyer belt 22 and sequentially passes through the print units 20Y, 20M, 20C and 20B. Subsequently, the paper P is fed from a side of the driver roller 24*a* to the heat roller-type fixer 32, where the full color image is thermally fixed on the paper P.

The optical head 40 is attached to the top cover 14. The paper conveyor belt 22 and roller 24*a* through 24*d* are integrated into one belt unit, to which the transfer element is attached.

Further, the present invention is not limited to these preferred embodiments, but various variations and modifications may be made without departing from the scope of the present invention.

According to the toner cartridge of the present invention, the agitator may feed toner to an external device and displace the partition. This simple structure displaces the partition without an additional member. According to the toner cartridges of the present invention, the vibration in the partition may unpile a waste toner heap in contact with it and level the waste toner by a simple structure. This effectively utilizes the second space and facilitates a small toner cartridge. According to the toner cartridge of present invention, a displacement of the partition would level the waste toner placed on it. This effectively utilizes the second space and facilitates a small toner cartridge. According to the toner cartridge of the present invention, a simple hinge structure may displace the partition. According to the toner cartridge of the present invention, the partition is not displaced when there is little waste toner in the second space, preventing an energy loss.

According to the toner cartridge of the present invention, the partition that contacts the agitator is made rigid and endurable, reducing an abrasion and breakage. According to the toner cartridge of the present invention, partition's projection that contacts the agitator is enhanced in endurance, reducing an abrasion and breakage. According to the toner cartridge of the present invention, even if all toner in the first space is collected by the second space, the second space would never overflow and enables the toner cartridge to be replaced when all the toner is drained from the first space. According to the toner cartridge of the present invention, the displacement of the partition would easily prevent a waste toner heap in the second space.

According to the print unit of the present invention, the agitator may feed toner to an external device and displace the partition. This simple structure displaces the partition without an additional member. According to the print unit of the present invention, the vibration in the partition may unpile a waste toner heap in contact with it and level the waste toner by a simple structure. This effectively utilizes the second space and facilitates a small toner cartridge. According to the print unit of the present invention, a displacement of the partition would level the waste toner placed on it. This effectively utilizes the second space and facilitates small toner cartridge. According to the print unit of the present invention, a simple hinge structure may displace the partition. According to the print unit of the present invention, the partition is not displaced when there is little waste toner in the second space, preventing an energy loss.

According to the print unit of the present invention, the partition that contacts the agitator is made rigid and endurable, reducing an abrasion and breakage. According to the print unit of the present invention, partition's projection that contacts the agitator is enhanced in endurance, reducing an abrasion and breakage. According to the print unit of the present invention, even if all toner in the first space is collected by the second space, the second space would never overflow and enables the toner cartridge to be replaced when all the toner is drained from the first space.

According to the storage device of the present invention, as a power supply to a processing device is originally provided for it, the partition is displaceable without a new power supply structure. According to the method of manufacturing the storage container of the present invention, the storage container can be manufactured using a simple three-layer partition placed in the wall. In addition, the manufacturing method may use ultrasound and/or heat, and thus its cost becomes relatively inexpensive. According to the printer of the present invention, the agitator may feed toner to the development part and displace the partition. This simple structure displaces the partition without an additional member.

What is claimed is:

1. A toner cartridge comprising:

a wall that defines an internal space;

a displaceable partition that divides the internal space into a first space that may store unused toner, and a second space that may store waste toner; and an agitator that agitates the toner in the first space and may displace said partition by contacting said partition.

2. A toner cartridge according to claim 1, wherein said partition is made of a sheet material that may vibrate elastically.

3. A toner cartridge according to claim 1, wherein the second space is arranged above the first space.

4. A toner cartridge according to claim 1, wherein said partition has a hinge structure.

5. A toner cartridge according to claim 1, wherein said partition may displace in accordance with an amount of the waste toner, and contact said agitator when the second space stores more than a predetermined amount of the waste toner.

6. A toner cartridge according to claim 1, wherein said partition has a rigid portion which contacts said agitator.

7. A toner cartridge according to claim 1, wherein said partition has a projection which contacts said agitator.

8. A toner cartridge according to claim 1, wherein the second space is as large as or larger than the first space.

9. A toner cartridge according to claim 1, wherein said wall includes:

a first opening which is connectable to the first space and openable; and a second opening which is connectable to the second space and openable, said first and second openings being arranged almost symmetrically with respect to said partition.

10. A print unit comprising:

a wall that defines an internal space;

a displaceable partition that divides the internal space into a first space that may store unused toner, and a second space that may store waste toner;

an agitator that agitates the toner in the first space and may displace said partition contacting said partition;

a photosensitive body; and a development part which forms a predetermined toner image on said photosensitive body.

11. A print unit according to claim 10, wherein said partition is made of a sheet material that may vibrate elastically.

12. A print unit according to claim 10, wherein the second space is arranged above the first space.

13. A print unit according to claim 10, wherein said partition has a hinge structure.

14. A print unit according to claim 10, wherein said partition may displace in accordance with an amount of the waste toner, and contact said agitator when the second space stores more than a predetermined amount of the waste toner.

15. A print unit according to claim 10, wherein said partition has a rigid portion which contacts said agitator.

16. A print unit according to claim 10, wherein said partition has a projection which contacts said agitator.

17. A print unit according to claim 10, wherein the second space is as large as or larger than the first space.

18. A storage device comprising:

a wall that defines an internal space;

a displaceable partition that divides the internal space into first and second spaces; and a processing member which performs a predetermined process in the first space, wherein power supplied to said processing member is partially utilized to make said processing member contact said partition and displace said partition.

19. A method of manufacturing a storage container comprising the steps of:

forming a processing member, first and second walls, and a displaceable partition;

aligning the first and second walls and partition with one another while storing the processing member in the first wall; and adhering the first wall, second wall and partition around the partition, wherein the processing member performs a predetermined process in a space defined by the first wall and partition and power supplied to the processing member is partially utilized to make the processing member contact the partition and displace the partition.

20. A method according to claim 19, wherein said adhering step adheres the partition using ultrasound.

21. A method according to claim 19, wherein said adhering step adheres the partition using heat.

22. A printer comprising:

a wall that defines an internal space;

a displaceable partition that divides the internal space into a first space that may store unused toner, and a second space that may store waste toner;

an agitator that agitates the toner in the first space and may displace said partition agitator by contacting said partition;

a photosensitive body;

a development part which forms a predetermined toner image on said photosensitive body; and a transfer device which transfer the toner image on a printing paper.

* * * * *